US005417025A

United States Patent [19]

Nute et al.

[11] Patent Number: 5,417,025

[45] Date of Patent: May 23, 1995

[54] RESILIENTLY MOUNTED ACCESSIBLE TILE

[75] Inventors: Ernest B. Nute, Lancaster; James P. Rineer, Pequea; Melvin H. Shaub, Lancaster, all of Pa.

[73] Assignee: Armstrong World Industries, Inc., Lancaster, Pa.

[21] Appl. No.: 172,752

[22] Filed: Dec. 27, 1993

Related U.S. Application Data

[63] Continuation of Ser. No. 5,451, Jan. 19, 1993, abandoned.

[51] Int. Cl.[6] ..... E04B 5/52

[52] U.S. Cl. ..... 52/483.1; 52/769; 52/779; 52/781

[58] Field of Search ..... 52/769, 779, 490, 773, 52/483.1, 489.1, 506.07, 506.08, 506.09, 778, 779, 780, 781

[56] References Cited

U.S. PATENT DOCUMENTS

| | | | |
|---|---|---|---|
| 2,481,794 | 9/1949 | Stitt . | |
| 3,488,908 | 1/1970 | Jahn | 52/586.1 |
| 3,714,753 | 2/1973 | Jahn | 52/489.1 |
| 3,900,997 | 8/1975 | Ollinger et al. | 52/476 |
| 4,169,340 | 10/1979 | Watson | 52/774 |
| 4,283,891 | 8/1981 | Moeller | 52/144 |
| 4,736,564 | 4/1988 | Gailey | 52/506.07 |
| 4,760,677 | 8/1988 | Nassof | 52/145 |

*Primary Examiner*—Carl D. Friedman
*Assistant Examiner*—Kien Nguyen

[57] ABSTRACT

The invention is a panel mounting system which uses two parallel support members. The support members engage two opposite sides of the panel. Resilient means on one side of the panel keep the opposite side of the panel in engagement with the support member engaging that side of the panel.

2 Claims, 2 Drawing Sheets

RESILIENTLY MOUNTED ACCESSIBLE TILE

CROSS-REFERENCE TO RELATED APPLICATION

This is a continuation of application Ser. No. 08/005,451, filed Jan. 19, 1993, now abandoned.

BACKGROUND OF THE INVENTION

1. Field of the Invention

This invention relates to a ceiling system that has easily removable ceiling panels resiliently held in position.

2. Description of the Prior Art

U.S. Pat. No. 3,488,908 discloses a ceiling with panels having opposite parallel edges that are kerfed but these cooperate with panels to permit upward accessibility while completely concealing the grid. There is no resilient means shown to secure the panels in place.

U.S. Pat. No. 3,714,753 discloses a ceiling with panels having opposite parallel edges that are kerfed but some of these kerfs in the panels house L-shaped supportable members which attach to specifically designed support elements in the runners to hold the ceiling panels in place. With a downward force, the supportable members detach from the ceiling structure permitting access above the ceiling panels. This disclosure completely conceals the grid and has no resilient means to secure the panels laterally.

U.S. Pat. No. 3,900,997 discloses a lay-in ceiling system using panels having one side kerfed to permit easy removal of the panel by moving the opposite edge of the panel upward. There is no resilient means disclosed.

U.S. Pat. No. 4,283,891 discloses a lay-in ceiling system using various metal spring clips to secure the panels into place and to allow downward access by shifting the panel laterally against the clip and then allowing it to lower. The clip is also used to eliminate the possibility of panels shifting and falling from the grid. However, the resilient spring clips are used between the ceiling molding members and the outside unkerfed ceiling panels rather than between individual kerfed ceiling panels.

U.S. Pat. No. 2,481,794 shows a lay-in ceiling which uses resilient spring clips to secure ceiling panels into position and allow easy access and removal while providing security in the grid structure. The clips are used between the ceiling molding members and the outside unkerfed ceiling panels rather than between individual kerfed ceiling panels.

SUMMARY OF THE INVENTION

The invention is a panel mounting system which uses at least two parallel support members. Each of the support members has at least one flange. The flange on each of two parallel support means face each other and the panel is positioned between the parallel support members and supported by the flanges. A resilient means positioned between one side of the panel and one support means holds the panel in position on the flange of the parallel support members. The flanges actually engage in kerfs cut in the edges of the ceiling panel. The, mounting system is used by inserting one side of the panel with the resilient means onto the flange of one of the support members to compress the resilient means. This then permits the other flange on the opposite side of the panel to be inserted into the kerf on the opposite side of the panel and when the pressure on the resilient means is released, this will permit both flanges to engage both kerfs and keep the ceiling panel mounted between the two parallel support means.

DESCRIPTION OF THE PREFERRED EMBODIMENT

Figure 1:
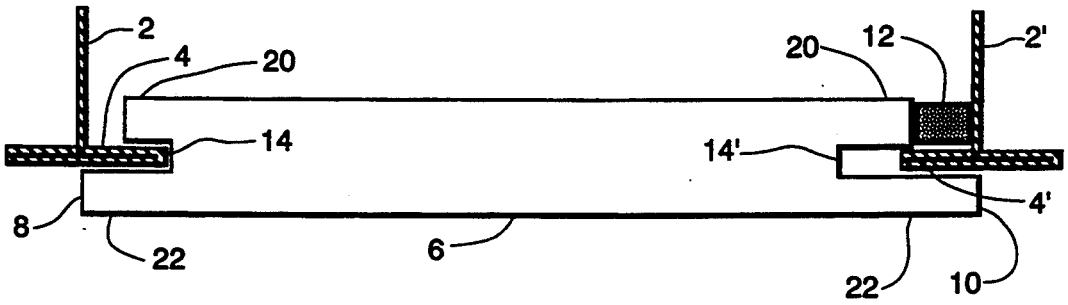
FIG. 1 is an end view of a panel mounted between two support elements which are ceiling runners.

Referring now to FIG. 1, there is shown a panel mounting system which comprises at least two parallel support means 2 and 2'. Each of the support means has at least one flange means shown as 4 and 4'. The flange means 4 and 4' which will position a single panel in position face each other. The panel 6, either metal, fiberboard or other material, is positioned between the parallel support means 2 and 2' with the flange means 4 and 4' engaging two opposite sides 8 and 10 of the panel. Specifically, the flanges are inserted into kerfs 14 and 14'. A resilient means 12 is positioned between one side of the panel 6 and one support means 2' to hold the panel in position on the flange means 4 and 4'.

The kerfs 14 and 14' are cut or otherwise formed in the edge of the ceiling panel between an extension member 20 of the panel which is in the plane of the back of the ceiling panel and an extension member 22 which is in the plane of the front of the ceiling panel. The extension members 20, one on each side of the panel, rest on the horizontal flanges 4 and 4' and support the ceiling panel in position. The extension members 22 overlie all or a portion of the downward facing face of the flange means 4 and 4' to provide a total or partial concealment to the face of the horizontal flanges.

Figure 2:
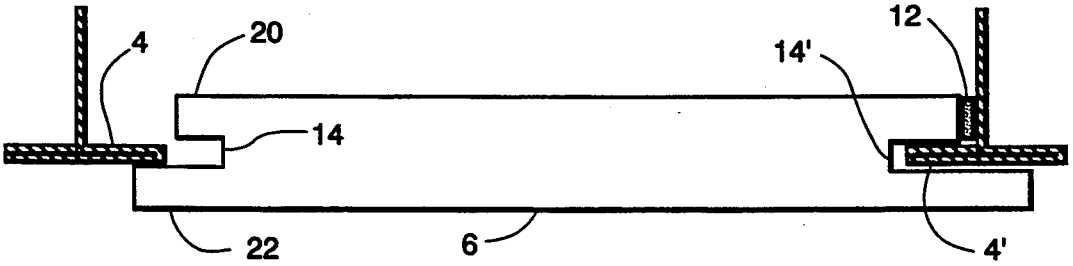
FIG. 2 is an end view of the same structure as FIG. 1 but showing the resilient means in a compressed state which permits the disengagement of one flange with its kerf.

FIG. 2 is a showing of how the ceiling panel is mounted in position. The ceiling panel 6 has the kerf 14' engaged with the flange 4' and the panel is moved or pushed from the left to the right to compress resilient means 12. This then clears the extension 20 from the edge of the flange 4 so that the panel may be pushed in an upward position so that now the flange 4 is in position to slide into the kerf 14. Releasing the force which is holding the ceiling panel to the right will now permit the ceiling panel to slide to the left and the ceiling panel will then be in the position of the FIG. 1 showing where elements 20 on both sides of the panel will support the panel relative the flanges 4 and 4'. The panel is removed by the reverse procedure. It is clear that the above provides an easy way to mount or remove panels.

Figure 3:
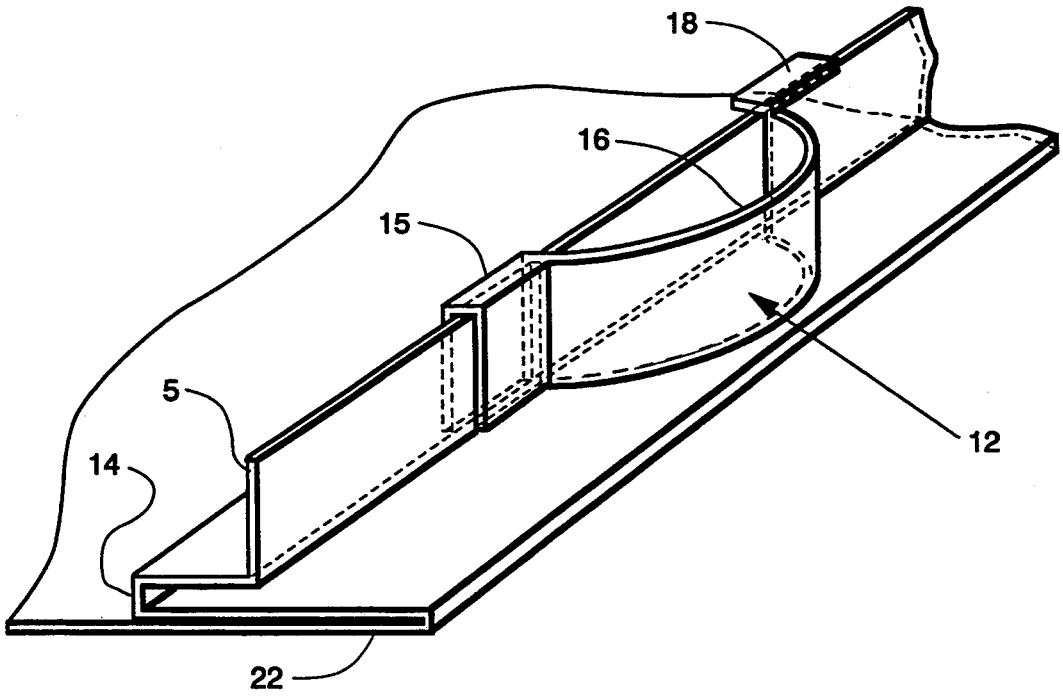
FIG. 3 is a perspective view of a different type of ceiling panel with a resilient spring means mounted thereon.

FIG. 3 is a showing of the edge of a ceiling panel if it was made from metal. The metal is bent to form the kerf 14. Element 5 is the same as the end of extension 20. Positioned on element 5 is resilient means 12 which is nothing more than a spring member. A clip 15 holds the spring member on element 5. Element 16 is the body of the spring which may be compressed by a force moving perpendicular thereto in the plane of the ceiling panel and element 18 is a tab which stabilizes the spring on element 5. It is obvious that the resilient means could be a piece of foam rubber, foam plastic or a resilient plastic strip or any other type of resilient structure which is capable of being slightly compressed. Naturally, a metal structure would use a clip 15 to hold the resilient means in position. This could be accomplished by the use of glue or any other fastening means, particularly when one would be looking at a conventional fiber ceiling panel or the ceiling panel as shown in FIG. 1.

Figure 4:
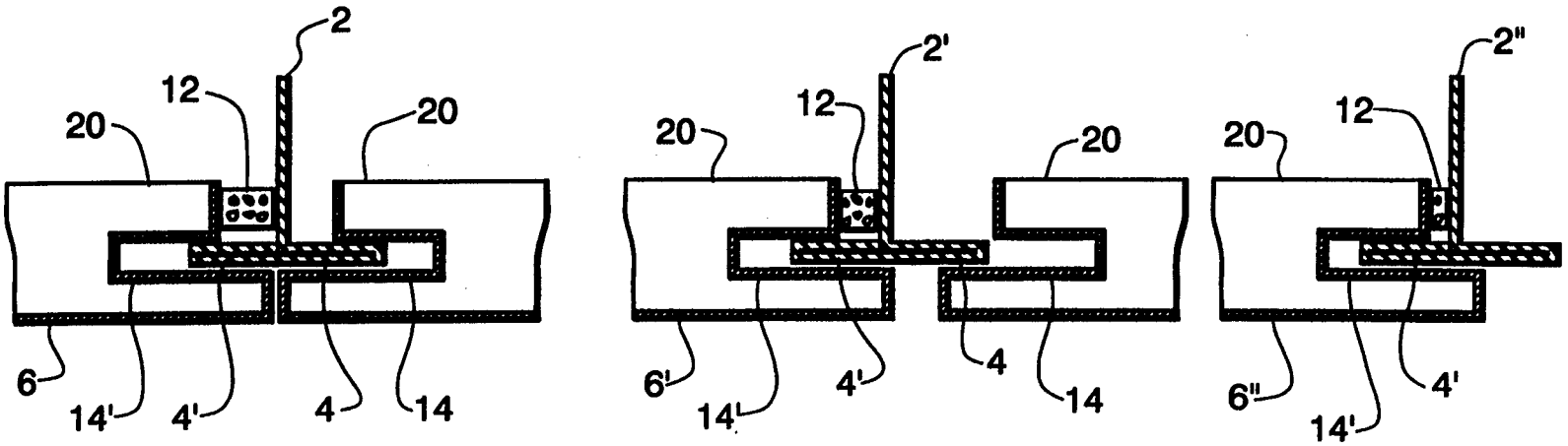
FIG. 4 is a sectional view through ceiling panels supported on parallel support means.

FIG. 4 shows parts of three ceiling panels 6, 6' and 6'' supported on three support means 2, 2' and 2''. Each ceiling panel has a left side kerf 14 and right side kerf 14'. A resilient means 12 is provided adjacent each kerf 14'. Ceiling panel 6 shows the right side kerf 14' with the flange means 4' inserted thereinto to support the panel by extension 20. Panel 6' shows the same right side configuration as described above for panel 6. Panel 6 on the left side thereof has flange means 4 in kerf 14 to support the panel 6' on extension 20. Panel 6'' shows the position of the panel when it is shifted to the right to compress resilient means 12 and permit the left extension 20 to clear the flange means 4 of support means 2'. Panels 6 and 6' are shown individually by FIG. 1 and panel 6'' is shown alone in FIG. 2. The structure of the metal panel in FIG. 4 is the same as the panel structure shown in FIG. 3.

What is claimed is:

1. A ceiling system comprising a plurality of inverted T-shaped grid members each with a horizontal flange member and a centrally located vertical grid, a plurality of all metal ceiling panels supported from the grid members, each ceiling panel having a face surface, a back surface and at least two opposite shaped edges which compliment the edges of adjacent ceiling panels to form a joint where two adjacent ceiling panels are supported from the same grid member, each ceiling panel has a first extension in the plane of the face surface of the panel and a second extension in the plane of the back surface of the ceiling panel on at least two opposite sides, the second extension in the plane of the back surface of the panel supports the panel on the horizontal flanges of two adjacent grid members, the first extension in the plane of the face surface of the panel overlies the horizontal flange member and partially or totally conceals horizontal flange member from view, a kerf is provided between the two extensions on the edge of the panel, each kerf has placed therein a flange of one of the adjacent grid members so that the side of the panel is not capable of up and down movement relative to the horizontal flange member, the other two opposed edges of the ceiling panel being unsupported by grid members, a third extension is provided perpendicular to the second extension, a resilient means is positioned on said third extension and between said third extension on one edge of the ceiling panel and the grid member to hold the ceiling panel in position on the horizontal flanges member of the adjacent grid member, but the ceiling panel may be moved sideward to compress the resilient means and release the horizontal flange member from the kerf on the edge of the panel opposite from the edge of the ceiling panel having the resilient means.

2. A ceiling system as set forth in claim 1 wherein the metal of the edge of the ceiling panel is bent to form the kerfs in the two opposite sides of the ceiling panel.

* * * * *